United States Patent [19]

Davies et al.

[11] 4,135,617

[45] Jan. 23, 1979

[54] ARTICLE CONVEYING MECHANISMS

[75] Inventors: Robert W. Davies; Leonard R. Wager, both of London, England

[73] Assignee: Molins Limited, London, England

[21] Appl. No.: 771,297

[22] Filed: Feb. 23, 1977

Related U.S. Application Data

[62] Division of Ser. No. 522,798, Nov. 11, 1974, Pat. No. 4,019,413.

[30] Foreign Application Priority Data

Nov. 15, 1973 [GB] United Kingdom ..... 53158/73

[51] Int. Cl.[2] ..... B65G 47/26

[52] U.S. Cl. ..... 198/458; 198/482; 198/796; 198/797

[58] Field of Search ..... 198/420, 458, 476, 480, 198/482, 484, 796, 797, 450, 570, 601, 448, 800, 803, 408; 53/148, 234, 376; 131/25

[56] References Cited

U.S. PATENT DOCUMENTS

| | | | |
|---|---|---|---|
| 2,965,214 | 12/1960 | Schlumpf et al. | 198/480 |
| 3,096,575 | 7/1963 | Cook | 198/420 |
| 3,135,373 | 6/1964 | Scarf | 198/797 |
| 3,303,926 | 2/1967 | Pohl | 198/800 |
| 3,457,701 | 7/1969 | Wainberg | 53/376 |
| 3,789,576 | 2/1974 | Giles | 53/234 |

FOREIGN PATENT DOCUMENTS

| | | | |
|---|---|---|---|
| 589257 | 12/1959 | Canada | 198/480 |
| 2429795 | 1/1975 | Fed. Rep. of Germany | 53/148 |
| 1074941 | 10/1954 | France | 53/234 |

*Primary Examiner*—Joseph E. Valenza
*Attorney, Agent, or Firm*—John C. Smith, Jr.

[57] ABSTRACT

In a cigarette packing machine bundles of cigarettes are wrapped in metallic foil and fed along two parallel rows. Successive foremost articles in the rows are inserted into holders of pairs of planetary mechanisms. After indexing of the mechanisms in opposite directions, the articles are ejected at a spacing less than that between the rows.

6 Claims, 4 Drawing Figures

ARTICLE CONVEYING MECHANISMS

This is a divisional application of pending parent application Ser. No. 522,798 filed on Nov. 11, 1974 now U.S. Pat. No. 4,019,413.

This invention concerns improvements in or relating to article conveying mechanisms, in particular for cigarette packing machines.

When packing cigarettes certain operations are carried out; namely, a bundle of cigarettes is first formed, the bundle is then wrapped in an inner wrapper e.g. of metallic foil, and a packet blank is folded and stuck around the bundle to form a packet containing the bundle.

The present invention is particularly concerned with machines which form bundles of cigarettes, and wrap each bundle in metallic foil. The wrapped bundles may then be fed to another machine to have packet blanks formed round them to produce a filled packet, e.g. a hinged lid packet.

According to the present invention there is provided apparatus for conveying articles comprising a pair of movable carrier means, means for moving said carrier means intermittently in opposite directions, first holder means mounted on one of said carrier means, second holder means mounted on the other of said carrier means, means for inserting an article into each of said first and second holder means when the latter are each stationary at an insertion position, means for removing an article from each of said first and second holder means when the latter are each stationary at an ejection position, wherein said pair of carrier means are so positioned that when said first and second holders are at said insertion position they are spaced a first distance apart, and when said first and second holder means are at said ejection position they are spaced a second and different distance apart.

Figure 1:
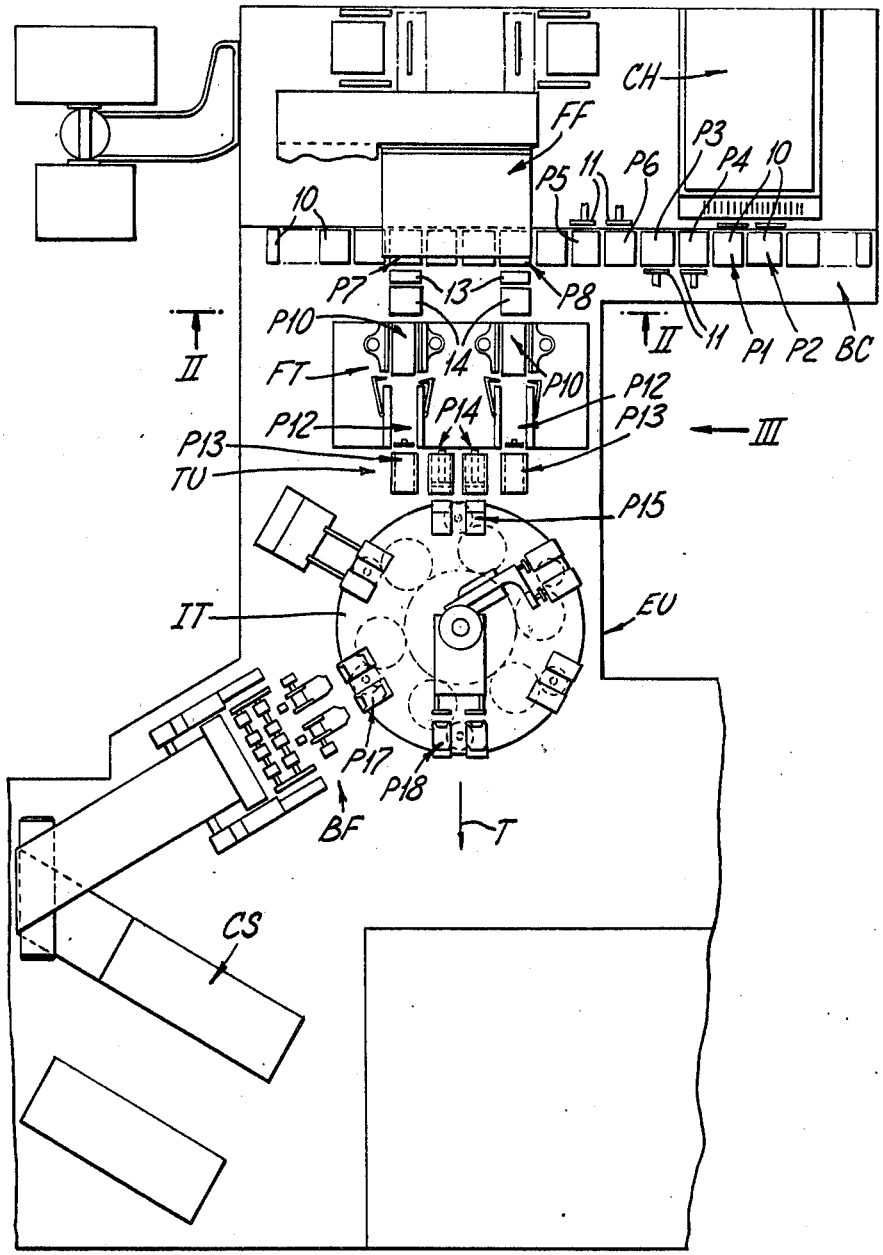
Figure 2:
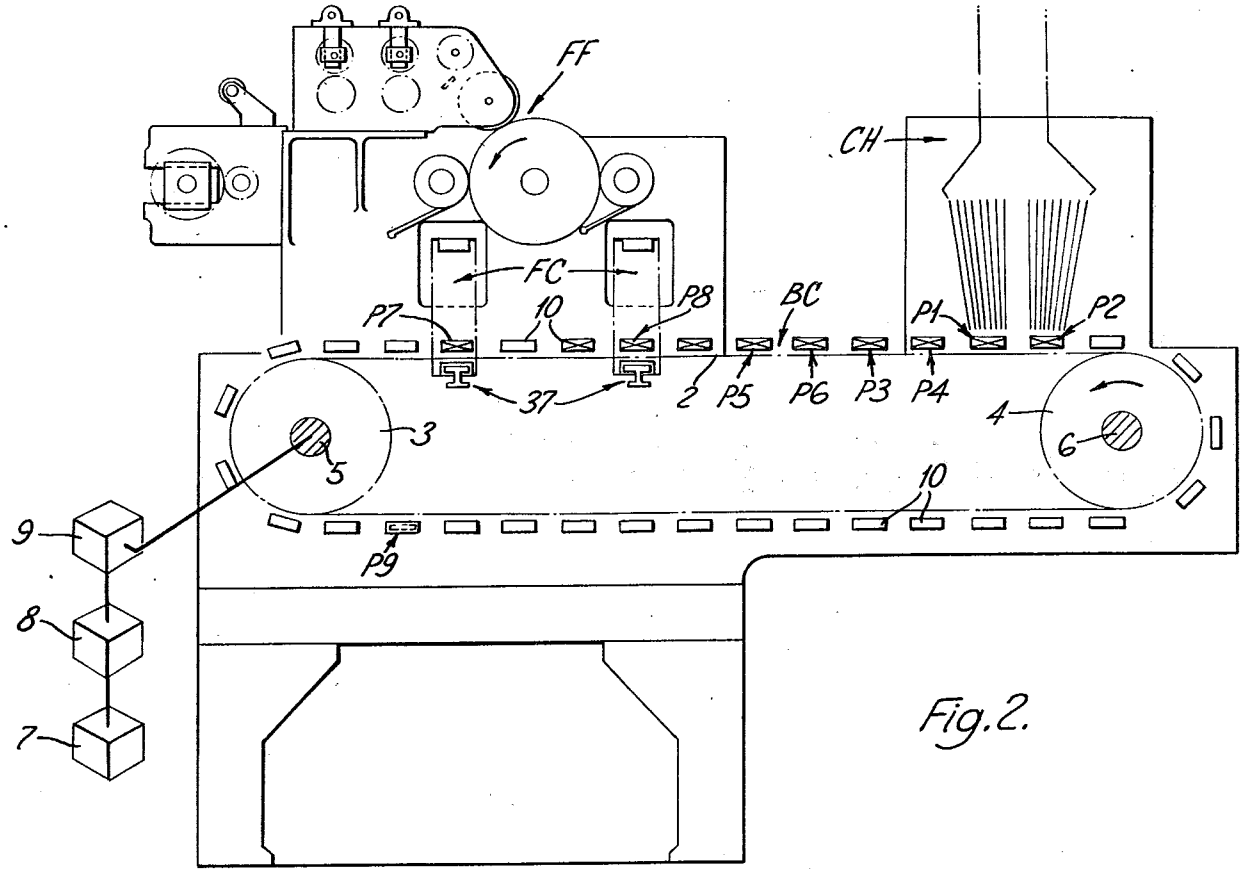
Figure 3:
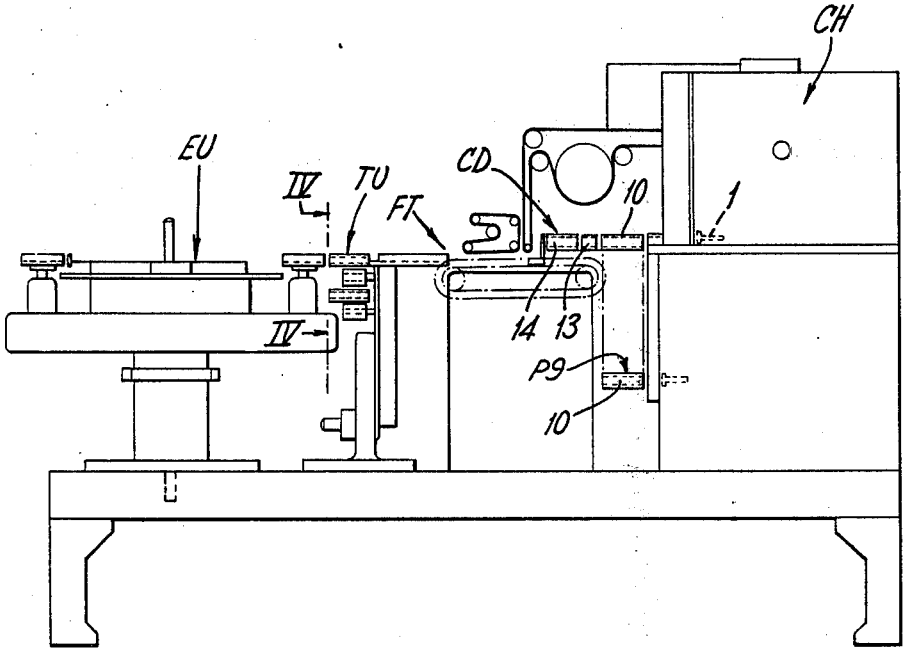
Figure 4:
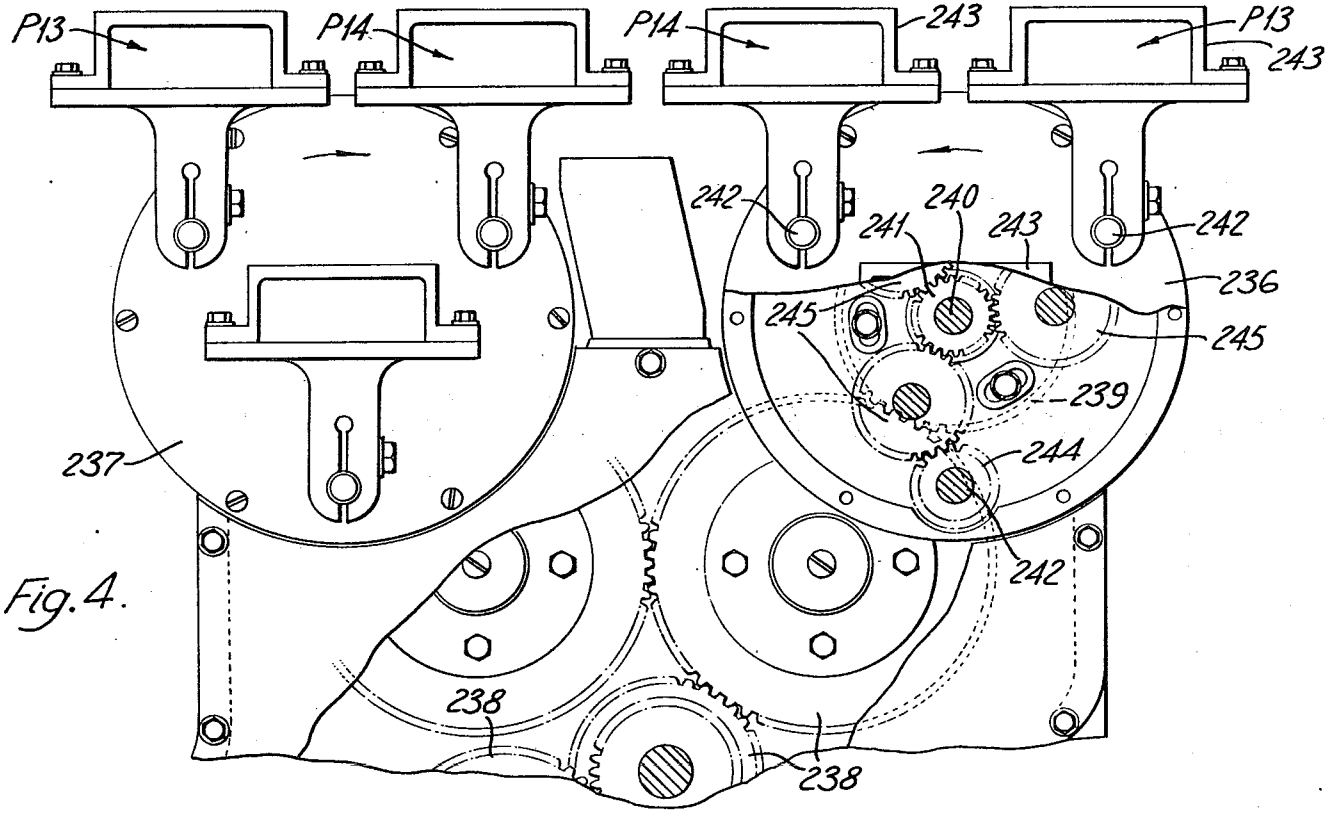

The invention will now be described, by way of examply only, with reference to the accompanying drawings in which:

FIG. 1 is a diagrammatic plan view of a preferred layout of machine for forming bundles of cigarettes and wrapping them in metallic foil, FIG. 2 is a view taken on the line II—II of FIG. 1, FIG. 3 is a side view of FIG. 1 taken in the direction of arrow III of FIG. 1, and FIG. 4 is a front view, partly in section, of part of the apparatus of FIG. 3 taken on the line XXII—XXII of that Figure, showing additional parts and drawn to a larger scale.

Referring to FIGS. 1, 2 and 3, the machine comprises basically the following units; a cigarette hopper CH, a cigarette bundle conveyor BC, a metallic foil feeding assembly FF which includes foil conveyor FC, a cigarette compression device CD, a foil folding and tucking unit FT, a bundle transfer unit TU and a bundle orientation and ejection unit EU.

Bundles of 20 cigarettes are formed, in known manner, in the hopper CH which may be of any convenient construction and is positioned so that the bundles may be removed therefrom two at a time, at positions P1, P2, FIG. 2, by two pushers 1, FIG. 3, only one of which is visible in the drawings, and fed onto the bundle conveyor BC. The latter comprises an endless conveyor band 2 which extends between two pulleys 3, 4 fixed to shafts 5, 6 respectively. The shaft 5, and thus also the conveyor 2, are driven intermittently by a motor, diagrammatically shown in FIG. 2 at 7, via a reduction gear box 8 and an indexing gear box 9 of any convenient known type having a continuously rotatable input shaft and an intermittently rotatable output shaft, the latter being connected to the shaft 5. Mounted on the conveyor band 2 are a plurality of hollow, openended pockets 10, the arrangement being such that each time the conveyor band 2 comes to rest, two consecutive pockets 10 are aligned, at positions P1, P2, with the pushers 1 which are then operated by cams (not shown) to push two bundles of cigarettes from the hopper CH into the waiting pockets 10. The conveyor band 2 is driven so that on each intermittent movement the pockets 10 are moved two pitches. Thus as the pockets are moved to the left (FIGS. 1, 2) away from positions P1, P2 all the pockets will contain a bundle of cigarettes.

Each time that the band 2 comes to rest the bundles of cigarettes at positions P3, P4 are aligned with two devices 11, FIG. 1, of any convenient known form, which are moved into engagement with one end of the cigarettes so as to test the firmness of one end of the cigarettes. Also the devices 11 may be used to test that the bundle contains the desired number of cigarettes. At the same time the bundles of cigarettes at positions P5, P6 are aligned with two further devices 11 which test the firmness of the opposite end of the cigarettes to that tested at positions P3, P4. Simultaneously, whilst the band 2 is at rest, the two bundles of cigarettes contained in the pockets 10 at positions P7, P8 are ejected, by two pushers (not shown), from their respective pockets and pushed through guide members 13 into two compression boxes 14. From here they are wrapped in foil, as described in the above-mentioned parent application, until at position P13 they arrive at the bundle transfer unit TU, FIG. 1.

Whilst in the unit TU the two wrapped bundles are moved towards each other until they come to rest at the positions indicated at P14 in FIGS. 1 and 4. The unit TU comprises two rotatable circular carriers 236, 237 driven intermittently in opposite directions, from the motor 7, via a gear box (not shown), which may be of the same type as the indexing gear box 9 or, alternatively, a Geneva indexing mechanism of any convenient form. The drive from such gear box to the carrier 236 is via a train of gears 238 and a gear 239, fixed to the carrier 236, carried on the shaft 240.

Also carried on the shaft 240 is a sun gear 241; and fixed to three stub shafts 242 carried by the carrier 236, are three holders 243 equi-spaced around the carrier 236. A planet gear 244 is attached to each stub shaft 242 and an idler gear 245 is positioned between, and meshes with, the sun gear and each of the planet gears 244. The ratio of the various gears within the carrier 236 is such that, as the holders 243 are carried around the axis of the shaft 240 by the carrier 236, they are maintained in the same orientation i.e. so that the wrapped bundle of cigarettes, contained therein, is always horizontal. The other carrier 237 is rotated, but in a clockwise direction, as viewed in FIG. 4, by identical gearing to that just described in relation to the carrier 236, so will not be described.

When the two holders 243 from positions P13 come to rest at the positions P14, the bundles of wrapped cigarettes are pushed by pushers, (shown dotted in FIG. 1), out of their respective holders 243 to a position P15 in the bundle orientation and ejection unit EU which, briefly, comprises an indexing table IT which rotates in steps in an anti-clockwise direction, as seen in FIG. 1.

While on the table IT, each pair of bundles is brought into position to receive a pair of inner frames from a blank forming assembly BF (which cuts and folds card from the card supply reel CS to produce a succession of such frames). Further movement of the table IT brings each pair of bundles to a discharge position from which the foil wrapped bundles (each assembled with an inner frame) travel in the direction indicated by arrow T towards a hinged lid packing machine, not forming part of the present invention.

We claim:

1. Apparatus for conveying cuboid articles such as bundles of cigarettes from two parallel rows of said articles, comprising a pair of rotors rotatable about axes parallel to said rows, each rotor being associated with one of said rows, a plurality of article holders mounted at regular intervals around each rotor, drive means to index said pair of rotors in opposite directions in steps corresponding to one of said intervals, means at a loading position for inserting a foremost article from each row onto an article holder of a respective rotor when stationary, and means at a discharge position for ejecting an article from each article holder when advanced a whole number of steps away from the respective row so that a pair of articles are ejected which are aligned but spaced apart a distance different than the spacing between said rows, each said rotor comprising a planetary gear system including a planet gear rigidly connected to each of said article holders, the gear ratios of said planetary gear system being such that said planet gears rotate bodily without change of orientation, whereby said article holders and said articles contained therein maintain the same orientation during movement of said rotor.

2. Apparatus according to claim 1 wherein said rotors are so arranged that said articles loaded at said loading position are in the same plane as said ejected pair of articles at said discharge position.

3. Apparatus according to claim 1 in which three article holders are mounted on each rotor.

4. Apparatus for conveying cuboid articles such as bundles of cigarettes comprising a. first means for feeding said articles along a first pair of parallel paths to respective loading positions;

b. second means for feeding said articles along a second pair of parallel paths from respective discharge positions;

c. said pairs of paths being parallel to each other and the distance between said paths of said first pair being different than the distance between said paths of said second pair;

d. a pair of rotors rotatable about axes parallel to said paths, each rotor being associated with one path of each of said pairs for transferring said articles from said loading position to said discharge position;

e. a plurality of article holders mounted at regular intervals around each rotor, said intervals being equal to the distance between said loading position of one of said paths of said first pair and said discharge position of one of said paths of said second pair;

f. drive means to index said pair of rotors in opposite directions in steps corresponding to one of said intervals;

g. means at each of said loading positions for inserting a foremost article from a path of said first pair onto an article holder of a respective rotor when stationary; and h. means at each of said discharge positions for ejecting an article from each article holder when advanced a whole number of steps away from the respective loading position so that a pair of articles are ejected at said discharge position;

i. each said rotor comprising a planetary gear system including a planet gear rigidly connected to each of said article holders, the gear ratios of said planetary gear system being such that said planet gears rotate bodily without change of orientation whereby said article holders and said articles contained therein maintain the same orientation during movement of said rotor.

5. Apparatus according to claim 4 in which the rotors are so arranged that the pair of loaded articles at said loading positions are in the same plane as the pair of ejected articles at said discharge position.

6. Apparatus according to claim 4 in which three article holders are mounted on each rotor.

* * * * *